United States Patent [19]

Craig

[11] 4,060,863

[45] Dec. 6, 1977

[54] CUSHIONS OR PILLOWS

[75] Inventor: Ashley Graham Craig, Wellington, New Zealand

[73] Assignee: Concraig Holdings Limited, London, England

[21] Appl. No.: 739,990

[22] Filed: Nov. 8, 1976

[51] Int. Cl.[2] ..... A47C 23/00; A47C 13/00

[52] U.S. Cl. ..... 5/337; 5/352

[58] Field of Search ..... 5/337, 338, 352, 345; 297/118, 456, 452, 461; D6/37, 39

[56] References Cited

U.S. PATENT DOCUMENTS

| | | | |
|---|---|---|---|
| 1,787,832 | 1/1931 | Mueller | 5/337 |
| 3,308,489 | 3/1967 | Winkler | 5/338 |
| 3,395,066 | 7/1968 | Tucker | 5/337 |
| 3,584,914 | 6/1971 | Williams | 5/337 |
| 3,616,171 | 10/1971 | Hoskinson | 5/337 |
| 3,911,512 | 10/1975 | Plate | 5/337 |

FOREIGN PATENT DOCUMENTS

| | | | |
|---|---|---|---|
| 1,048,632 | 11/1966 | United Kingdom | 5/337 |

*Primary Examiner*—Philip C. Kannan

[57] ABSTRACT

A cushion or pillow including a cover, the cushion or pillow being generally V-shaped, having arms of equal length, the inner side of the V being concavely curved.

12 Claims, 3 Drawing Figures

CUSHIONS OR PILLOWS

This invention relates to cushions or pillows.

The invention provides a cushion or pillow comprising a cover, the cushion or pillow being generally V-shaped, having arms of equal length, the inner side of the V being concavely curved.

The cover may be impermeable to air and have an air inlet valve and may in use be filled with air.

Alternatively the pillow may further comprise a resilient filling of fragmentary material in which case the filling of the cushion may comprise feathers, particulate foam material or a polyester filament fibre staple.

In the case where the filling comprises a polyester filament fibre staple the filling may be constituted by Terylene P3 (R.T.M.) or Dacron Fibrefill 2 (R.T.M.).

In the case where the filling comprises particulate foam material the filling may be constituted by Dunlopreme Polyether.

Preferably, in all of the above cases the angle at the apex of the V is a right angle.

The following is a description of a specific embodiment of the invention, reference being made to the accompanying drawing in which.

Figure 1:
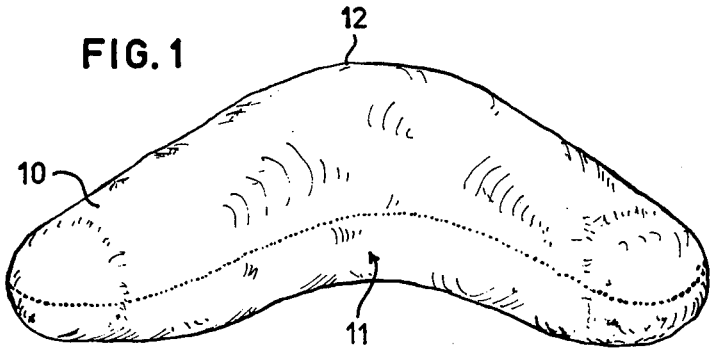
FIG. 1 is a perspective view of a pillow.

The drawing shows a pillow 10 having a generally V-shaped appearance, the arms of the pillow being equal in length and the angle at the apex of the pillow being a right angle.

The inner side of the V has, at the apex of the V a shallow concave curvature as indicated at 11 so that the width of the cushion increases towards the apex. The outer side of the V at the apex has a more sharply curved convex corner 12.

The pillow comprises a cover of a washable cotton or synthetic polyester and the filling comprises a polyester filament fibre staple such as Terylene P3, or Dacron 2. In this case the whole pillow is washable.

In use, the pillow is located against a support surface with the V inverted to receive the back, shoulders and head of the user. The pillow can be thus used against a bed-head, seat back or a wall.

In alternative embodiments the filling may be constituted by feathers or particulate foam material e.g. Dunlop Polyether.

Figure 2:
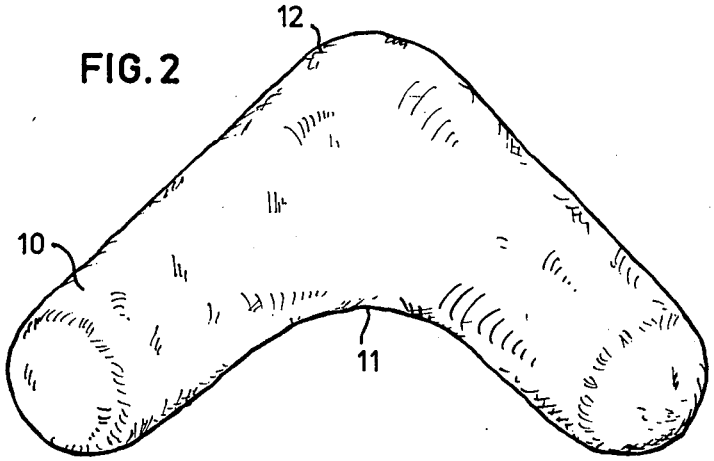
FIG. 2 is a plan view of the pillow.
Figure 3:
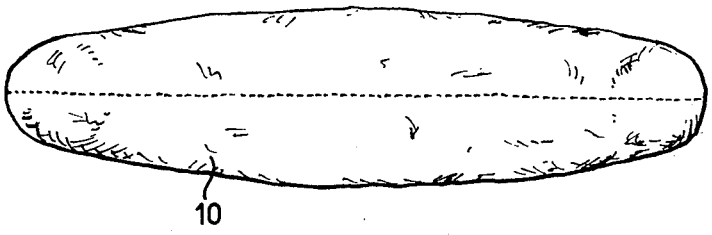
FIG. 3 is an elevation view of the pillow.

In a further embodiment the cover of the pillow is made from air impermeable material and has an air inlet valve formed in it. In this embodiment the filling is constituted by air, which is introduced into the cover through the air inlet valve to inflate the cover into the shape shown in FIGS. 1 to 2.

I claim:

1. A cushion or pillow comprising:

a flexible elongate generally V-shaped body having arms which are of equal length and which are connected together at one end to form an apex section, said apex section having an outer surface and an inner surface which is disposed between said arms;

said apex section being concave in three intersecting planes which are at substantially right angles with each other so that said arms form an angle with each other and the thickness of said body adjacent said outer surface exceeds that thickness adjacent said inner surface, said body thereby presenting a surface which is substantially flat from top to bottom when said body is in a folded configuration with said arms substantially in contact with each other.

2. The cushion or pillow of claim 2, further including a cover.

3. A cushion or pillow as claimed in claim 2 wherein the cover is made of air impermeable material and includes an air inlet valve.

4. A cushion or pillow as claimed in claim 2 further comprising a resilient filling of fragmentary material.

5. A cushion or pillow as claimed in claim 4 wherein the filling comprises feathers.

6. A cushion or pillow as claimed in claim 4 wherein the filling comprises particulate foam material.

7. A cushion or pillow as claimed in claim 4 wherein the filling is constituted by a polyester filament fibre staple.

8. A cushion or pillow as claimed in claim 7 wherein the filling is constituted by Terylene P3.

9. A cushion or pillow as claimed in claim 7 wherein the filling is constituted by Dacron fibrefill 2.

10. A cushion or pillow as claimed in claim 6 wherein the filling is constituted by Dunlopreme Polyether.

11. A cushion or pillow as claimed in any one of the preceding claims wherein the angle at the apex of the V is a right angle.

12. The cushion or pillow of claim 1, wherein said arms are longitudinally tapered.

* * * * *